US007294215B2

(12) United States Patent
Tsuyama et al.

(10) Patent No.: US 7,294,215 B2
(45) Date of Patent: Nov. 13, 2007

(54) METHOD AND DEVICE FOR COOLING STEEL SHEET

(75) Inventors: Seishi Tsuyama, Okayama (JP); Akio Fujibayashi, Hiroshima (JP); Akira Tagane, Kanagawa (JP); Isao Takahashi, Hiroshima (JP); Kazuo Omata, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 229 days.

(21) Appl. No.: 10/489,382

(22) PCT Filed: Sep. 11, 2002

(86) PCT No.: PCT/JP02/09252

§ 371 (c)(1),
(2), (4) Date: Apr. 30, 2004

(87) PCT Pub. No.: WO03/026813

PCT Pub. Date: Apr. 3, 2003

(65) Prior Publication Data

US 2004/0244886 A1 Dec. 9, 2004

(30) Foreign Application Priority Data

Sep. 21, 2001 (JP) ..... 2001-290004

(51) Int. Cl.
*C21D 1/667* (2006.01)
*C21D 1/64* (2006.01)
*C21D 9/573* (2006.01)

(52) U.S. Cl. ..... 148/661; 148/654; 148/637; 148/638; 266/113; 266/114

(58) Field of Classification Search ..... 148/661, 148/654, 637, 638, 644; 266/113, 114
See application file for complete search history.

(56) References Cited

FOREIGN PATENT DOCUMENTS

| | | | | |
|---|---|---|---|---|
| EP | 0 080 932 A1 | | 6/1983 | |
| JP | 358157517 | * | 9/1983 | ..... 72/201 |
| JP | 60-43435 A | | 3/1985 | |
| JP | 60070126 A | | 4/1985 | |
| JP | 361229414 | * | 10/1986 | ..... 134/122 R |
| JP | 62021413 A | | 1/1987 | |

(Continued)

*Primary Examiner*—Deborah Yee
(74) *Attorney, Agent, or Firm*—Frishauf, Holtz, Goodman & Chick, PC

(57) ABSTRACT

The present invention relates to a method for cooling a steel plate comprising the steps of: forming a water pool with jets of cooling water being injected to impinge on one another by using one slit-nozzle and a plurality of induced laminar flow nozzles, the slit nozzle being provided in a position on an upper surface side of the steel plate, and the induced laminar flow nozzles being provided in a position on a lower surface side of the steel plate along a transfer direction and a direction perpendicular to the transfer direction; and passing the steel plate into the water pool, wherein when a top portion of the steel plate passes over the induced laminar flow nozzles located at least on the side of highest upstream, a volume of the cooling water to be injected from each of the induced laminar flow nozzles is reduced. According to the method of the present invention, when on-line cooling is performed for a hot rolled steel plate, the top portion of the steel plate can be prevented from being super cooled, and the steel plate can therefore be uniformly cooled.

17 Claims, 4 Drawing Sheets

FOREIGN PATENT DOCUMENTS

| | | | |
|---|---|---|---|
| JP | 63-168215 | A | 7/1988 |
| JP | 2-179828 | A | 7/1990 |
| JP | 2000-1719 | A | 6/1998 |
| JP | 10166023 | A | 6/1998 |
| JP | 410291019 | * | 11/1998 |
| JP | 11-347629 | A | 12/1999 |

* cited by examiner

PRIOR ART

METHOD AND DEVICE FOR COOLING STEEL SHEET

This application is a U.S. National Phase Application under 35 USC 371 of International Application PCT/JP02/09252 filed Sep. 11, 2002.

TECHNICAL FIELD

The present invention relates to a method for cooling a steel plate, more specifically, a method for uniformly cooling a steel plate on a production line after hot rolling, and an apparatus therefor.

BACKGROUND ART

When performing on-line cooling of a hot rolled steel plate, it is difficult to uniformly cool upper and lower surfaces of the steel plate with the same cooling capability. Particularly, on the lower surface, after impingement of cooling water upon the steel plate, the cooling water is immediately moved away by the force of gravity from the steel plate. As such, no cooling beyond cooling only with impinging water jets can be accomplished, so that the cooling capability for the lower surface is lower than that for the upper surface of the steel plate. For this reason, conventionally, uniformity of cooling has been implemented by changing a volume of the cooling water that is applied to the upper and lower surfaces of the steel plate. However, depending on temperature, thickness, and the like factors of the steel plate, and temperature of the cooling water, an optimal volume of the cooling water on the upper and lower surfaces is different. This makes it difficult to implement uniform cooling therefore facilitating occurrence of cooling nonuniformity. As such, the steel plate after cooling can have problems of deformation, residual stress, and nonuniformity in properties, consequently leading to operational troubles and deterioration in production yield.

In order to solve these problems, various cooling apparatuses have been proposed, such as those for enhancing cooling capability for a lower surface of steel plate and those for uniformly cooling upper and lower surfaces of steel plate.

Japanese Examined Patent Publication No. 63-4604 discloses a cooling apparatus as shown in FIG. 1.

This cooling apparatus has a water tank 2 provided with a predetermined spacing on a lower surface side of a steel plate 1; a round-tubular cooling nozzle 3 vertically fixed to a bottom portion of the water tank 2; and a conduit 4 that is vertically installed in an upper portion of the cooling nozzle 3 and that has a cross section substantially similar to a cross section of the cooling nozzle 3 and larger than the cross section of the cooling nozzle 3. A top portion of the cooling nozzle 3 and a bottom portion of the conduit 4 are positioned below the water surface, and a top portion of the conduit 4 is exposed above the water surface.

The cooling nozzle 3 having the conduit 4 is called an induced laminar flow nozzle (for water cooling) 6. The publication describes that the lower surface of the steel plate 1 can be stably and uniformly cooled by the nozzle, and the cooling capability can be controlled in a wide range.

Japanese Unexamined Patent Application Publication No. 10-166023 discloses a cooling apparatus as shown in FIG. 2.

This cooling apparatus has cooling nozzles 3A installed on an upper surface side of a steel plate 1 and cooling nozzles 3B installed on a lower surface side of a steel plate 1 between individual sets of transfer rollers 7. The number of the cooling nozzles 3B on the lower surface side is larger than the number of the cooling nozzles 3A on the upper surface side. In addition, between the individual sets of the transfer rollers 7, the cooling nozzles 3A and 3B are disposed so that cooling starts synchronously for the upper and lower surfaces of the steel plate 1. The publication describes that the arrangement equalizes cooling capabilities for the upper and lower surfaces of the steel plate 1. The publication further describes that when the induced laminar flow nozzles of the type described above are used for the cooling nozzles 3B on the lower surface side of the steel plate, even more uniform cooling can be implemented for the upper and lower surfaces, occurrence of distortion is prevented, and in addition, nonuniformity in properties is reduced.

However, problems remain even in the case that the cooling apparatus described in Japanese Examined Patent Publication No. 63-4604 or Japanese Unexamined Patent Application Publication No. 10-166023 is used. In this case, in the top (front) portion of the steel plate, the temperature significantly drops after hot rolling, and in addition, the super cooling is liable to occur because of turbulent flows of the cooling water, consequently causing camber of the steel plate. Especially, when the induced laminar flow nozzles as described in Japanese Examined Patent Publication No. 63-4604 are used, since the cooling water once returned into the water tank after cooling of the steel plate is used to cool the center portion of the steel plate, the temperature of the water is high. This causes significant super cooling of the top portion of the steel plate, thereby further facilitating occurrence of camber.

Japanese Examined Patent Publication No. 5-61005 discloses a method proposed to prevent such super cooling in the top portion of the steel plate. According to the method, a shield plate movable downwardly of the steel plate is installed, and cooling water drawn up from the lower surface side is thereby prevented from going up to the upper surface of the steel plate.

According to the method, however, the top portion of the steel plate is not cooled at any time because of the shield plate, so that uniform cooling cannot be performed in the longitudinal direction of the steel plate.

DISCLOSURE OF THE INVENTION

An object of the present invention is to provide a method for uniformly cooling a steel plate and therefore preventing a top portion of the steel plate from being super cooled, when performing on-line cooling of the steel plate after hot rolling, and an apparatus therefor.

The object is achieved by a method for cooling a steel plate comprising the steps of: forming a water pool with jets of cooling water being injected to impinge on one another by using one slit nozzle and a plurality of induced laminar flow nozzles, the slit nozzle being provided in a position on an upper surface side of the steel plate, and the induced laminar flow nozzles being provided in a position on a lower surface side of the steel plate along a transfer direction and a direction perpendicular to the transfer direction; and passing the steel plate into the water pool, wherein when a top portion of the steel plate passes over the induced laminar flow nozzles located at least on the side of highest upstream, a volume of the cooling water to be injected from each of the induced laminar flow nozzles is reduced. It is particularly effective that the cooling method is repeatedly carried out a plurality of times.

The method described above can be implemented using a cooling apparatus comprising: one slit nozzle provided in a position on an upper surface side of the steel plate; and a plurality of induced laminar flow nozzles provided in a position on a lower surface side of the steel plate along a transfer direction and a direction perpendicular to the transfer direction, wherein a plurality of cooling zones are provided for cooling the steel plate by forming a water pool with cooling water being injected from the slit nozzle and the induced laminar flow nozzles, and a cooling water control means is provided in the cooling zone located on the side of highest upstream among the plurality of cooling zones to control a volume of the cooling water to be injected from each of the induced laminar flow nozzles located at least on the side of highest upstream.

EMBODIMENTS FOR CARRYING OUT THE INVENTION

The first feature of the cooling method of the present invention lies in that to uniformly cool a steel plate by equalizing cooling capabilities for the upper and lower surfaces of the steel plate, cooling water is injected from one slit nozzle provided on the upper surface side of the steel plate and a plurality of induced laminar flow nozzles provided on the lower surface side of the steel plate so that jets of the cooling water impinge upon each other in such a manner as to form a water pool, and then the steel plate is passed into the water pool.

The present method avoids a phenomenon, as is observed in a conventional method, that the cooling water is injected from the cooling nozzles toward the upper and lower surfaces of the steel plate, water-volume densities are therefore increased in portions where the cooling water are brought into contact with the steel plate, and the portions are super cooled as compared with peripheral portions, thereby causing cooling nonuniformity.

Figure 1:
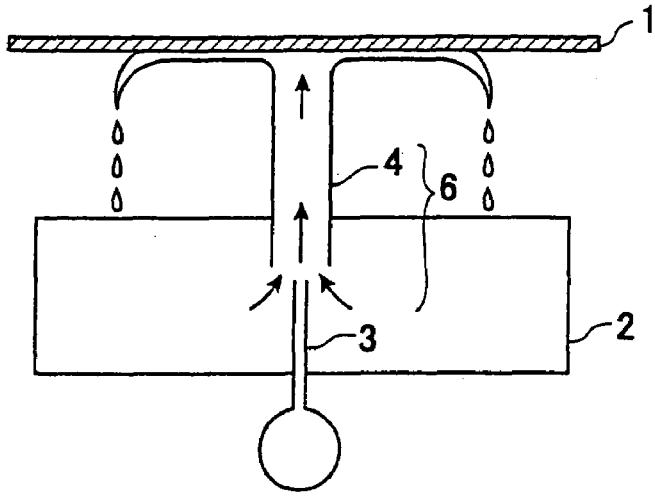
FIG. 1 is a view schematically showing an apparatus for cooling a steel plate described in Japanese Examined Patent Publication No. 63-4604.
Figure 2:
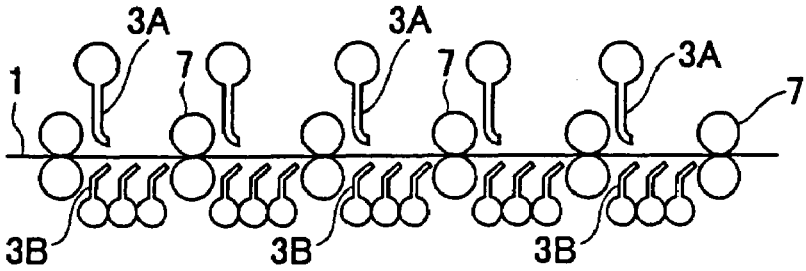
FIG. 2 PRIOR ART
FIG. 2 is a view schematically showing an apparatus for cooling a steel plate described in Japanese Unexamined Patent Application Publication No. 10-166023.
Figure 3:
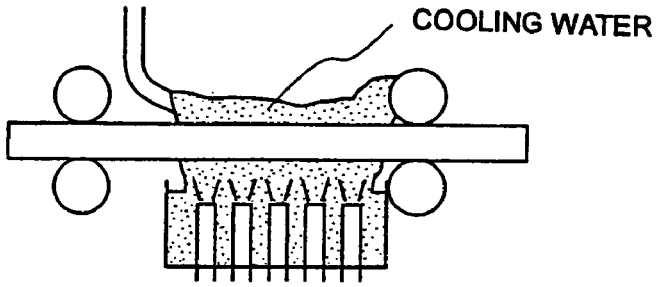
FIG. 3 is a view schematically showing an example of a method for cooling a steel plate according to the present invention.

FIG. 3 schematically shows an example of a method for cooling a steel plate according to the present invention.

The steel plate is cooled in a water pool formed by one slit nozzle provided on the upper surface side of the steel plate and a plurality of induced laminar flow nozzles provided on the lower surface side of the steel plate. Thereby, the steel plate and the cooling water can be brought into secure contact with each other, and the cooling capabilities for the lower surface of the steel plate can be enhanced. Consequently, uniform cooling can be implemented.

Figure 4:
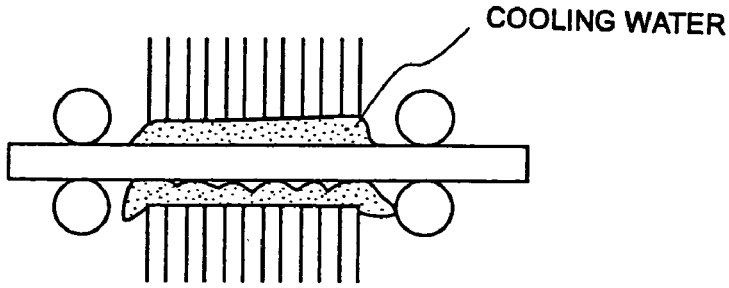
FIG. 4 is a view schematically showing a comparative example of a method for cooling a steel plate.
Figure 5:
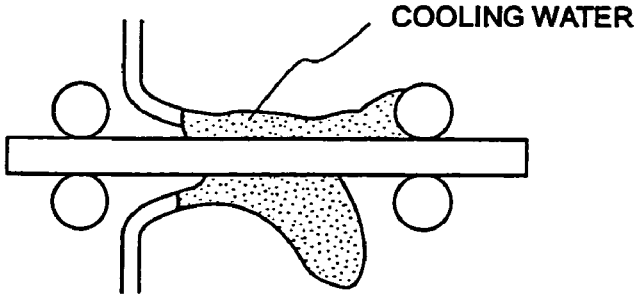
FIG. 5 is a view schematically showing another comparative example of a method for cooling a steel plate.

In comparison, FIG. 4 shows an example using spray nozzles on both upper and lower surface sides, and FIG. 5 shows an example using slit nozzles on both upper and lower surface sides of the steel plate.

Compared with FIG. 3, a water pool is not formed in any examples shown in FIG. 4 and FIG. 5 and some regions on the lower surface side where the steel plate and the cooling water are not in contact locally are formed, so that cooling nonuniformity is caused.

The second feature of the cooling method according to the present invention lies in that to prevent the top (front) portion of the steel plate from being super cooled, the volume of cooling water injected from each of induced laminar flow nozzles is reduced when the top portion of the steel plate passes over the induced laminar flow nozzles on the side of highest upstream.

Figure 6:
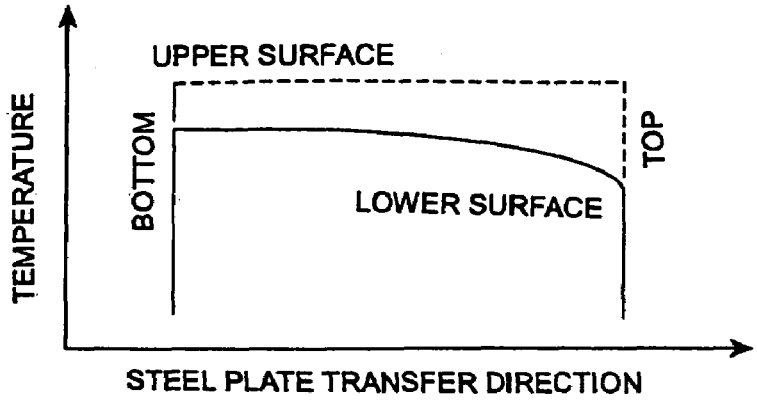
FIG. 6 is a view showing temperature profiles of upper and lower surfaces of a steel plate in a longitudinal direction of the steel plate immediately after cooling performed according to a conventional method.

As shown in FIG. 6, the temperature difference between the upper and lower surfaces of the steel plate immediately after cooling performed according to the conventional method increases to be highest in the top portion of the steel plate.

Figure 7:
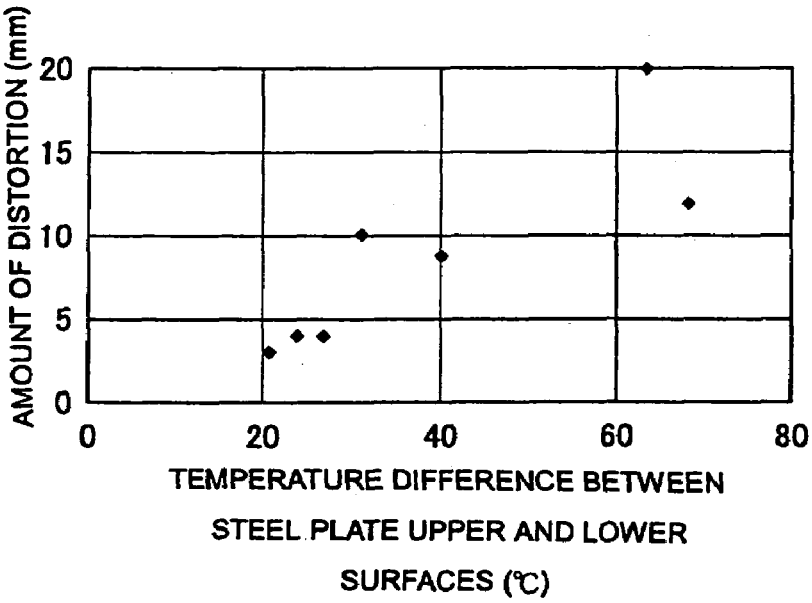
FIG. 7 is a view showing the relationship between a temperature difference between upper and lower surfaces of a steel plate and an amount of distortion on the upper and lower surfaces of the steel plate.
Figure 8:
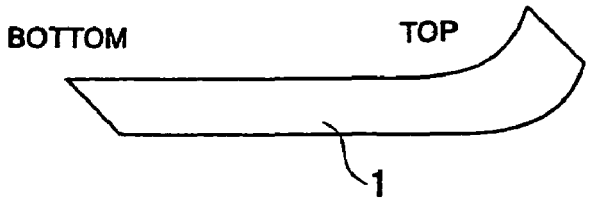
FIG. 8 is a view schematically showing a shape of the steel plate after cooling performed according to a conventional method.

As shown in FIG. 7, when the temperature difference, between the upper and lower surfaces of the steel plate thus increases, the amount of distortion of the steel plate is increased. This causes upward camber in the top portion of the steel plate wherein the temperature difference between the upper and lower surfaces is increased. When such camber occurs in the top portion, the top portion of the steel plate must be rectified (leveled) in the subsequent process by using a cold leveler or a press, machine, consequently leading to an increase in manufacturing cost.

As described above, in order to prevent such camber in the top portion, when the top portion of the steel plate passes at least over the induced laminar flow nozzles located on the side of highest upstream, the volume of the cooling water injected from each of the induced laminar flow nozzles may preferably be reduced to prevent the top portion of the steel plate from being super cooled.

Figure 9:
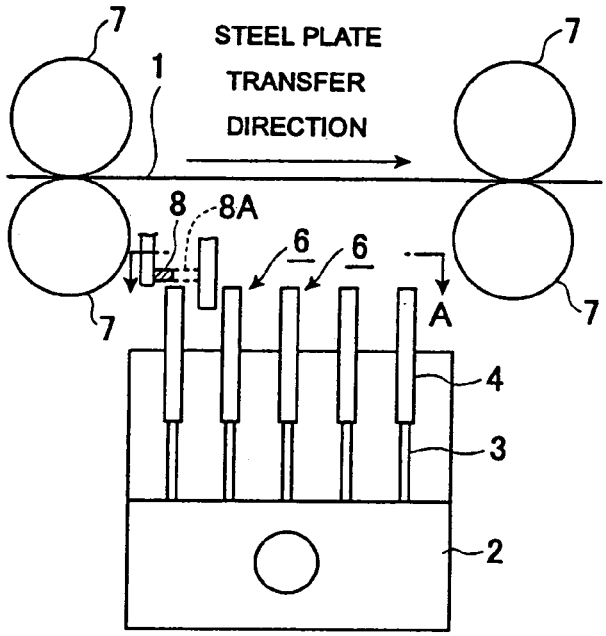
FIG. 9 is a view showing an example of induced laminar flow nozzles employed in the cooling apparatus of the present invention.
Figure 10:
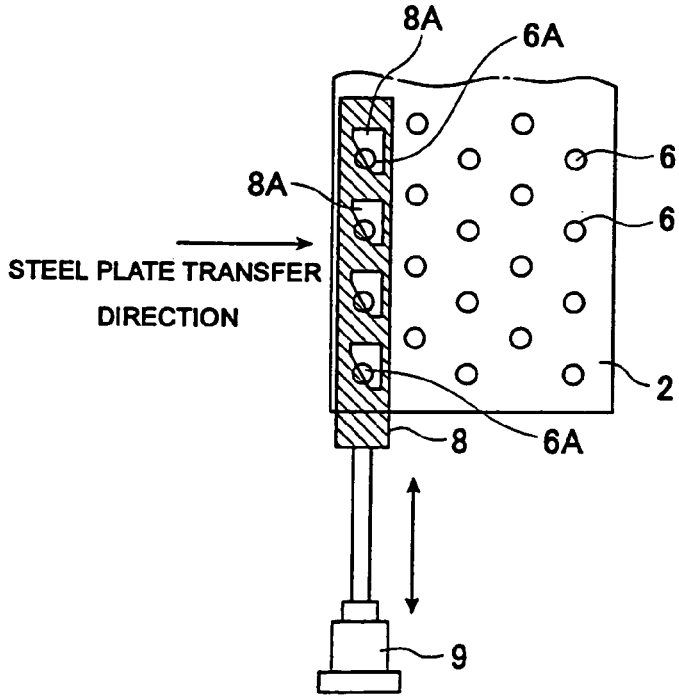
FIG. 10 is a cross sectional view taken along the line A-A of FIG. 9.

FIG. 9 schematically shows an example of induced laminar flow nozzles used in the apparatus for cooling a steel plate according to the present invention. FIG. 10 is a cross sectional view taken along the line A-A of FIG. 9.

Shown in FIG. 9 are induced laminar flow nozzles 6 situated in a cooling zone allocated by a set of transfer rollers 7. In an actual line (a cooling line), a plurality of such cooling zones are provided, wherein a plurality of induced laminar flow nozzles 6 are located along the width direction and the transfer direction of the steel plate 1.

As shown in FIG. 10, over the induced laminar flow nozzles 6A on the side of highest upstream (i.e., at the upstream side, or entrance side, of the cooling zone), a shield plate 8 is provided that is horizontally movable by a moving means 9 in the direction perpendicular to the transfer direction of the steel plate and that has a plurality of openings 8A at a predetermined pitch. When the top portion of the steel plate passes over the induced laminar flow nozzles 6A, the shield plate 8 is horizontally moved, and as a result, a part of cooling water injected to the lower surface of the steel plate 1 from the induced laminar flow nozzles 6A is blocked. Thereby, the top portion of the steel plate is prevented from being super cooled.

When the cooling water is completely blocked by using the shield plate 8, distortion can generate in the steel plate because of a difference in the first contact positions with the cooling water between the upper and lower surfaces of the steel plate in the transfer direction. For this reason, it is preferable that the half of an opening of each of the induced laminar flow nozzles 6A be closed to reduce the volume of the cooling water to about ½ of the normal volume of the cooling water.

Ordinarily, the shield plate 8 is positioned where the openings of the induced laminar flow nozzles 6A are each fully opened. However, when the top portion of the steel plate is detected by sensors (not shown) located between sets of transfer rollers 7, the shield plate 8 horizontally moves to close the half of the opening of each of the induced laminar flow nozzles 6A. After the top portion of, the steel plate passes over the induced laminar flow nozzles 6A, the shield plate 8 is horizontally moved to fully open the openings of the individual induced laminar flow nozzles 6A. Thereby, cooling capabilities for the upper and lower surfaces of the steel plate are equalized.

The induced laminar flow nozzles 6 to be closed by the shield plate 8 are not always limited to one line of nozzles on the side of highest upstream, but may be provided in a plurality of lines of nozzles.

By repeating the operations described above in the subsequent cooling zones, the top portion of the steel plate can be prevented substantially completely from being super cooled. These operations should only be conducted until uniform temperature distribution is attained on the upper and lower surfaces of the steel plate; that is, the operations need not be performed in all the cooling zones.

When the steel plate is cooled by repeating the above described operations in a plurality of cooling zones, if the steel plate is air cooled in at least two of the cooling zones, water cooling and air cooling can be alternately performed, which allows to control the properties of the steel plate in a wider range.

Provision of a flow regulating valve in each of the cooling zones enables finer cooling control of the steel plate. In the case that water cooling and air cooling are alternately performed, the flow regulating valve may be replaced with an on/off valve.

When the top portion of the steel plate passes in each of the cooling zones, if not only the volume of the cooling water to be injected from induced laminar flow nozzles but also the volume of the cooling water to be injected from a slit nozzle is reduced, temperature drop in the top portion of the steel plate can be prevented.

In the present invention, it is effective to dispose a rectifying means on an entrant side of the cooling zone located on the side of highest upstream, whereby the steel plate is rectified and then cooled. This enables uniform cooling and prevention of distortion during cooling. The rectifying means is used to rectify hot steel plates having a thickness of 50 mm or less, so that it may be of the type having a simple construction as compared with an ordinary hot rectifying machine.

EXAMPLE

Using the individual cooling methods as shown in FIGS. 3 to 5, steel plates each having a thickness of 20 mm, a width of 4,000 mm, and a length of 12 to 36 m were individually transferred at a transfer speed of 45 mpm and were concurrently cooled from 800° C. to 500° C. or a room temperature. At this time, a shield plate was provided on the lower surface side of steel plate, and injection of cooling water to the top portion of the steel plate was thereby controlled. Then, hot rectification was performed, the amount of distortion in the top portion of the steel plate was measured at room temperature, and cooling uniformity was evaluated.

The result is shown in Table 1.

In the cases of the examples 1 to 3 cooled by using the method shown in FIG. 3 with a shielding plate, any one of the examples exhibited a very small amount of distortion in the width direction and in the top portion, regardless of the length of steel plate and the cooling termination temperature. As such, rectification was not required in the subsequent process.

However, although the method shown in FIG. 3 was used, comparative example 1 for which the top portion of the steel plate was not shielded exhibited a large amount of distortion in the top portion. In the cases of the comparative examples 2 to 5 for which the method shown in FIG. 4 or 5 was applied, each of the examples exhibited a large amount of distortion in the width direction and in the top portion. As such, rectification was required in the subsequent process for these comparative examples.

TABLE 1

| Testing | Method | Shielding conditions | Length of steel plate (m) | Cooling termination temperature (° C.) | Width distortion (mm) | Top portion distortion (mm) |
|---|---|---|---|---|---|---|
| Example 1 | FIG. 3 | Top portion only | 12 | 500 | 3 | 2 |
| Example 2 | FIG. 3 | Top portion only | 36 | 500 | 5 | 2 |
| Example 3 | FIG. 3 | Top portion only | 36 | Room temperature | 4 | 3 |
| Comparative example 1 | FIG. 3 | None | 12 | 500 | 5 | 45 |
| Comparative example 2 | FIG. 4 | Top portion only | 12 | 500 | 60 | 20 |
| Comparative example 3 | FIG. 4 | None | 12 | 500 | 80 | 50 |
| Comparative example 4 | FIG. 5 | Top portion only | 12 | 500 | 50 | 45 |

TABLE 1-continued

| Testing | Method | Shielding conditions | Length of steel plate (m) | Cooling termination temperature (° C.) | Width distortion (mm) | Top portion distortion (mm) |
|---|---|---|---|---|---|---|
| Comparative example 5 | FIG. 5 | None | 12 | 500 | 65 | 50 |

The invention claimed is:

1. A method for cooling a steel plate comprising:

forming, at a cooling zone for cooling the steel plate, a water pool with jets of cooling water that are injected to impinge on one another from: (i) one slit nozzle positioned at an upper surface side of the steel plate, and (ii) a plurality of induced laminar flow nozzles positioned at a lower surface side of the steel plate, said induced laminar flow nozzles being arrayed both along a transfer direction of the steel plate and along a direction perpendicular to the transfer direction;

passing the steel plate into the water pool at the cooling zone; and when a front portion of the steel plate passes over at least upstream-most ones of the induced laminar flow nozzles, which are located at an entrance side of the cooling zone, reducing a volume of the cooling water that reaches the steel plate from said at least the upstream-most induced laminar flow nozzles;

wherein the reduction in the volume of the cooling water is not performed when a rear portion of the steel plate passes over said at least the upstream-most induced laminar flow nozzles.

2. The method according to claim 1, wherein said forming of the water pool, said passing the steel plate into the water pool, and said reducing of the volume of the cooling water is carried out at a plurality of cooling zones on a cooling line.

3. The method according to claim 2, further comprising air cooling the steel plate at least at two positions on said cooling line between positions where the water pools are formed.

4. The method according to claim 2, wherein when said reduction in the volume of the cooling water is carried out to reduce the volume of the cooling water that impacts the front portion of the steel plate from the induced laminar flow nozzles on the lower surface side of the steel plate, a volume of the cooling water that reaches the steel plate from the slit nozzle positioned at the upper surface side of the steel plate is also reduced.

5. The method according to claim 1, wherein reducing of the volume of the cooling water comprises blocking a portion of the cooling water that is injected from said at least the upstream-most induced laminar flow nozzles, after the cooling water leaves said at least the upstream-most induced laminar flow nozzles.

6. The method according to claim 5, wherein said blocking is performed using a steel plate that includes a plurality of holes corresponding respectively to said at least the upstream-most induced laminar flow nozzles, each of said holes comprising: (i) a first portion that does not block the cooling water injected from the corresponding induced laminar flow nozzle when the first portion is positioned over the corresponding induced laminar flow nozzle, and (ii) a second portion that blocks a portion of the cooling water injected from the corresponding induced laminar flow nozzle when the second portion is positioned over the corresponding induced laminar flow nozzle; and wherein said blocking is performed by positioning the respective second portion of each of the plurality of holes over the corresponding one of said at least the upstream-most induced laminar flow nozzles.

7. The method according to claim 6, wherein a shape of a periphery of each hole is different at the first portion of the hole than at the second portion of the hole.

8. The method according to claim 1, wherein said at least the upstream-most induced laminar flow nozzles consists of an upstream-most row of the reduced laminar flow nozzles.

9. The method according to claim 2, further comprising leveling the steel plate prior to cooling the steel plate.

10. An apparatus for cooling a steel plate comprising:

a plurality of cooling zones along a cooling line, wherein each of at least a plurality of the cooling zones comprises:

one slit nozzle positioned at an upper surface side of the steel plate for injecting cooling water;

a plurality of induced laminar flow nozzles positioned at a lower surface side of the steel plate for injecting cooling water, said induced laminar flow nozzles being arrayed both along a transfer direction of the steel plate and along a direction perpendicular to the transfer direction, wherein a water pool is formed in the cooling zone by the cooling water injected from the one slit nozzle and the induced laminar flow nozzles; and cooling water control means for, when a front portion of the steel plate entering the water pool passes over at least upstream-most ones of the induced laminar flow nozzles, which are located at an entrance side of the cooling zone, reducing a volume of the cooling water that reaches the steel plate from said at least the upstream-most induced laminar flow nozzles, and for not reducing the volume of the cooling water when a rear portion of the steel plate passes over said at least the upstream-most induced laminar flow nozzles.

11. The apparatus according to claim 10, wherein the cooling water control means comprises a shield plate.

12. The apparatus according to claim 11, wherein the shield plate includes a plurality of holes corresponding respectively to said at least the upstream-most induced laminar flow nozzles, each of said holes comprising: (i) a first portion that does not block the cooling water injected from the corresponding induced laminar flow nozzle when the first portion is positioned over the corresponding induced laminar flow nozzle, and (ii) a second portion that blocks a portion of the cooling water injected from the corresponding induced laminar flow nozzle when the second portion is positioned over the corresponding induced laminar flow nozzle.

13. The apparatus according to claim 12, wherein the cooling water control means further comprises means for moving the shield plate to reduce the volume of the cooling water that reaches the steel plate from said at least the upstream-most induced laminar flow nozzles by positioning the respective second portion of each of the plurality of holes over the corresponding one of said at least the upstream-most induced laminar flow nozzles.

14. The apparatus according to claim 12, wherein a shape of a periphery of each hole is different at the first portion of the hole than at the second portion of the hole.

15. The apparatus according to claim 10, wherein said at least the upstream-most induced laminar flow nozzles consists of an upstream-most row of the reduced laminar flow nozzles.

16. The apparatus according to claim 10, further comprising a flow regulating valve provided for each of the cooling zones to regulate a volume of the cooling water to be injected from the slit nozzle and the volume of the cooling water to be injected from each of the induced laminar flow nozzles.

17. The apparatus according to claim 10, further comprising leveling means for leveling the steel plate, wherein the leveling means is provided upstream of an upstream-most one of the cooling zones on the cooling line in the transfer direction of the steel plate.

* * * * *